US007311590B1

(12) United States Patent
Muldowney

(10) Patent No.: US 7,311,590 B1
(45) Date of Patent: Dec. 25, 2007

(54) POLISHING PAD WITH GROOVES TO RETAIN SLURRY ON THE PAD TEXTURE

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/700,346

(22) Filed: Jan. 31, 2007

(51) Int. Cl.
*B24B 1/00* (2006.01)

(52) U.S. Cl. ..... 451/526; 451/527; 451/287

(58) Field of Classification Search ..... 451/41, 451/59, 63, 287, 526, 527
See application file for complete search history.

(56) References Cited

U.S. PATENT DOCUMENTS 6,241,596 B1 * 6/2001 Osterheld et al. ..... 451/527
6,783,436 B1 8/2004 Muldowney
6,843,709 B1 1/2005 Crkvenac et al.
6,843,711 B1 1/2005 Muldowney
6,955,587 B2 10/2005 Muldowney
7,059,949 B1 6/2006 Elmufdi et al.
7,059,950 B1 6/2006 Muldowney
7,108,597 B2 9/2006 Muldowney
7,125,318 B2 10/2006 Muldowney
7,131,895 B2 11/2006 Elmufdi et al.
7,234,224 B1 * 6/2007 Naugler et al. ..... 29/557
2007/0032182 A1 * 2/2007 Suzuki ..... 451/527
2007/0066195 A1 * 3/2007 Duong ..... 451/526

* cited by examiner

*Primary Examiner*—Eileen P. Morgan
(74) *Attorney, Agent, or Firm*—Blake T. Biederman

(57) ABSTRACT

A rotational chemical mechanical polishing pad designed for use with a polishing medium. The polishing pad includes a polishing layer having a polishing surface containing a plurality of grooves. At least a portion of each of the plurality of grooves has a shape and orientation determined as a function of the trajectory of the polishing medium during use of the pad.

9 Claims, 7 Drawing Sheets

POLISHING PAD WITH GROOVES TO RETAIN SLURRY ON THE PAD TEXTURE

BACKGROUND OF THE INVENTION

The present invention generally relates to the field of chemical mechanical polishing (CMP). In particular, the present invention is directed to a CMP pad having grooves that reduce slurry consumption.

In the fabrication of integrated circuits and other electronic devices on a semiconductor wafer, multiple layers of conducting, semiconducting and dielectric materials are deposited onto and etched from the wafer. Thin layers of these materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization and polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another.

Indeed, most groove patterns are based on speculative judgment about how slurry flow responds to various groove characteristics, such as, for example, groove curvature and groove cross-section. These characteristics often play an essential role in influencing the migration of dispensed slurry under the centripetal force actuated by the rotating polisher. As groove orientation changes from more circular to more radial, the outward migration of the dispensed slurry increases. Radial grooves, for example, may cause the greatest radial outflow of the dispensed slurry by acting like channels that direct liquid off the polishing pad entirely. This outflow negatively impacts the polishing process by allowing excessive heating of contact points between the polishing pad and the wafer surface, causing such problems as poor polish performance and greater pad wear.

While polishing pads have a wide variety of groove patterns, the effectiveness of these groove patterns varies from one pattern to another, as well as from polishing process to polishing process. Polishing pad designers are continually seeking groove patterns that make the polishing pads more effective and useful relative to prior polishing pad designs.

STATEMENT OF THE INVENTION

In one aspect of the invention, a polishing pad for use in conjunction with a polishing medium having an ideal trajectory imparted by the rotation of the polishing pad during use, the polishing pad comprising: a polishing layer configured for polishing at least one of a magnetic, optical and semiconductor substrate in the presence of a polishing medium, the polishing layer including a circular polishing surface having an annular polishing track during polishing; and at least one groove formed in the polishing layer and having an orthogonal portion located within the polishing track, the orthogonal portion having a length and being shaped along the entire length to be orthogonal to the ideal fluid trajectory along the orthogonal portion.

In another aspect of the invention, a polishing pad, comprising: a polishing layer configured for polishing at least one of a magnetic, optical and semiconductor substrate in the presence of a polishing medium; and at least one groove formed in the polishing layer and having an orthogonal portion located within the polishing track, the orthogonal portion having a length and being shaped in accordance with the equation $$r^* = r_O e^{\frac{1}{2}(3\theta)^{3/2}}$$

where $r_o$ is the initial radial position from a concentric center of the polishing pad and $\theta$ is the trajectory angle.

In yet another aspect of the invention, a method of making a rotational polishing pad for use with a polishing medium, comprising: determining a trajectory for the polishing medium; determining a groove shape and a groove orientation of a groove to be formed in the rotational polishing pad as a function of the trajectory for the polishing medium; and forming in the rotational polishing pad a plurality of grooves having the groove shape and the groove orientation.

DETAILED DESCRIPTION OF THE INVENTION

Figure 1:
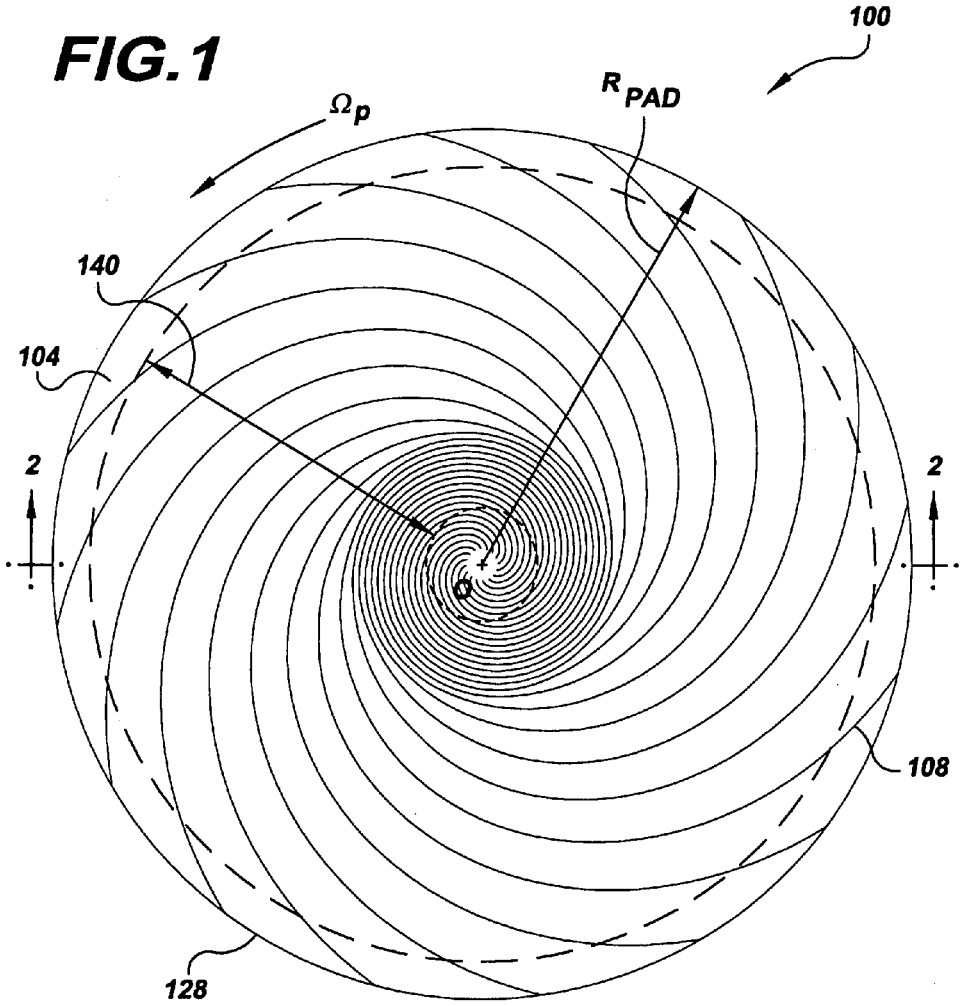
FIG. 1 is a plan view of a polishing pad made in accordance with the present invention.
Figure 3:
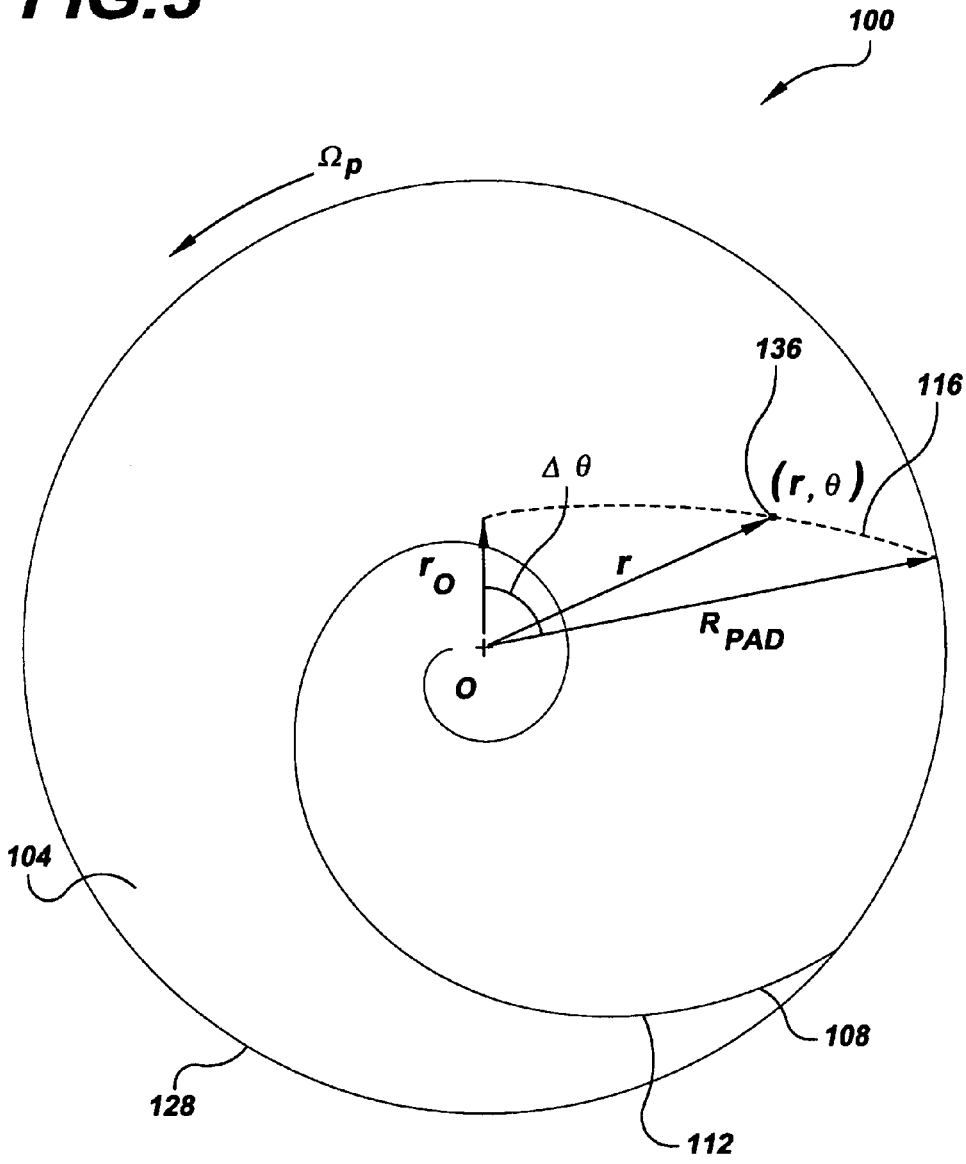
FIG. 3 is a schematic top view of the polishing pad of FIG. 1 illustrating the shape of one of the grooves on the pad relative to an idealized fluid trajectory.

Referring now to the drawings, FIGS. 1 and 3 illustrate one embodiment of a polishing pad 100 made in accordance with the present disclosure. As discussed below, polishing pad 100 is designed in a manner that impedes the tendency of a polishing medium (not shown), e.g., slurry, to migrate outward due to the centripetal force imparted on the polishing medium by the rotation of polishing pad 100 during use. Generally, polishing pad 100 includes a polishing surface 104 containing a plurality of grooves 108 each having a groove shape 112 (FIG. 3) at least partially determined as a function of a fluid trajectory 116 (FIG. 3) that defines the mean path of motion along which the polishing medium would travel as the polishing pad rotates during use if grooves 108 were not present. More particularly, all or a portion of groove shape 112 and its orientation relative to the rotational direction of polishing pad 100 are selected so that the corresponding respective groove 108 is orthogonal to fluid trajectory 116. As such, grooves 108 or portions thereof that are orthogonal to fluid trajectory 116, provide a significant impediment to the polishing medium flowing across polishing surface 104 and off of polishing pad 100, thereby increasing the retention time of the polishing medium on the pad. Increased retention times lead to lower polishing medium consumption and, therefore, lower operating costs. Details of various exemplary geometries of grooves 108 are described below.

Figure 2:
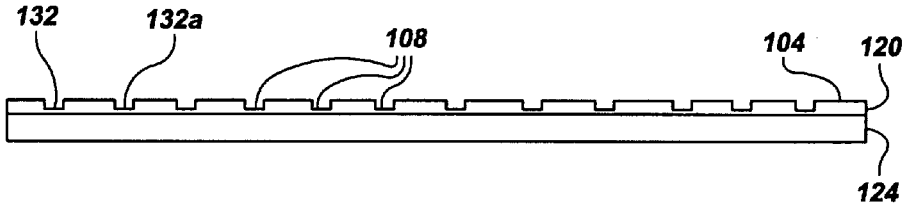
FIG. 2 is an exaggerated cross-sectional view of the polishing pad of FIG. 1 as taken along line 2-2 of FIG. 1.

Referring to FIG. 1, and also to FIG. 2, polishing pad 100 may include a polishing layer 120 (FIG. 2) that forms polishing surface 104. In one example, polishing layer 120 may be supported by a backing layer 124, which may be formed integrally with polishing layer 120 or may be formed separately from polishing layer 120. Referring again to FIG. 1, polishing pad 100 typically has a circular disk shape so that polishing surface 104 has a concentric center O and a circular outer periphery 128. The latter may be located a radial distance from O, as illustrated by radius Rpad. Polishing layer 120 may be made out of any material suitable for polishing the article being polished, such as a semiconductor wafer, magnetic media article, e.g., a disk of a computer hard drive or an optic, e.g., a refractive lens, reflective lens, planar reflector or transparent planar article, among others. Examples of materials for polishing layer 120 include, for the sake of illustration and not limitation, various polymer plastics, such as a polyurethane, polybutadiene, polycarbonate and polymethylacrylate, among many others.

Each of the plurality of grooves 108 may be formed in polishing layer 120 in any suitable manner, such as by milling, molding, etc. In one example, grooves 108 are formed distinct from one another and are arranged repetitively at a constant pitch around concentric center O. In addition, each of the plurality of grooves 108 may be formed with a groove cross-sectional shape 132 (FIG. 2) as desired to suit a particular set of design criteria. In one example, each of the plurality of grooves 108 may have a rectangular cross-sectional shape, e.g., as shown by groove cross-sectional shape 132*a*. In another example, each groove 108 may have a groove cross-section 132 that varies along its length. In yet another example, cross-sectional shape 132 may vary from one groove 108 to another groove 108. Those having ordinary skill in the art will understand the wide range and various applications of groove cross-sectional shape 132 that a designer may provide to a polishing pad, such as polishing pad 100.

Referring again to FIG. 3, fluid trajectory 116 depicted is an idealized trajectory that a fluid, e.g., water, would traverse under the influence of the rotation of polishing pad 100 if polishing surface 104 were fluid-phobic, e.g., hydrophobic, and did not include any grooves 108 or other structural impediments to its movement. The following mathematical derivation is based on this idealized trajectory. However, it is recognized that the true trajectory of a polishing medium on an actual pad surface may vary from the ideal trajectory due to influences of various factors, such as polishing medium viscosity and surface tension, not considered in the idealized trajectory. Consequently, fluid trajectory 116 also represents the true trajectory of a given polishing medium as the medium responds to the physical forces imparted by polishing pad 100 and the rotation of the pad. To simplify the explanation of concepts underlying the present disclosure, however, the mathematics for only the ideal unimpeded trajectory are presented in detail below. This does not necessarily mean that the present disclosure covers only groove shapes laid out in accordance with the following mathematics. On the contrary, the present disclosure is intended to accommodate actual fluid trajectories during rotation of an equivalent grooveless pad, regardless of whether or not these trajectories are defined by the following ideal-trajectory mathematical model.

For convenience, fluid trajectory 116 may be defined by a plurality of points having polar coordinates indicating a radial position r and a trajectory angle θ, e.g., point 136 (r, θ). These points define the pattern of an idealized polishing medium as it travels outward on polishing surface 104 under the influence of angular velocity $\Omega_p$ of polishing pad 100. In this example, fluid trajectory 116 is the variation in the angular displacement Δθ as the radial position r of the polishing medium increases with respect to concentric center O.

In general, the polishing medium continuously accelerates as the radial position r increases with respect to concentric center O. Fluid trajectory 116 may be related to the angular velocity $v_r$ of the polishing medium as the medium moves outward from concentric center O. The angular velocity $v_r$ may be described as the change in the radial position r from concentric center O measured with respect to time t, as shown in Equation 1.

$$v_r = \frac{dr}{dt} \quad \text{Equation \{1\}}$$

It will be readily appreciated that the centripetal force imparted on the polishing medium as polishing pad 100 rotates at a constant angular velocity $\Omega_p$ causes an acceleration a of the polishing medium as it moves outward along polishing surface 104 (which, again, is assumed to be grooveless, smooth and fluid-phobic for simplicity of the mathematical model). Acceleration a is expressed in Equation 2.

$$a = \frac{dv_r}{dt} = r\Omega_p^2 \quad \text{Equation \{2\}}$$

This acceleration increases with an increase in the radial position r from concentric center O. The increasing acceleration results in an increasing angular velocity $v_r$, which may be determined by integrating Equation 2 and applying an initial angular velocity value $v_r=0$, as would occur when the polishing medium is dispensed onto polishing surface 104 without imparting an initial angular velocity $v_r$. The result is shown in the following Equation 3.

$$v_r = r\Omega_p^2 t \quad \text{Equation \{3\}}$$

It follows that the variation of radial position r with respect to time t may be described by combining Equations 1 and 3, as shown in Equation 4, which may be separated and integrated to provide the result shown in Equation 5, where C is a constant of integration.

$$\frac{dr}{dt} = r\Omega_p^2 t \quad \text{Equation \{4\}}$$

$$\ln(r) = \frac{1}{2}\Omega^2 t^2 + C \quad \text{Equation \{5\}}$$

Further, the variation of radial position r may be associated with the variation in angular displacement Δθ measured with respect to time t, as shown in Equations 6 and 7.

$$t = \frac{\Delta\theta}{\Omega_p} \quad \text{Equation \{6\}}$$

$$\ln(r) = \frac{1}{2}\Delta\theta + C \quad \text{Equation \{7\}}$$

This equation, i.e., Equation 7, may be arranged to define the variation in angular displacement Δθ with the change in radial position r by applying the boundary condition Δθ=0 when $r=r_o$, as shown in Equation 8. The variation in angular displacement Δθ described by Equation 8 may provide the pattern of a polishing medium traveling outward on the rotating idealized polishing surface 104 under continuous acceleration as the radial position r increases with respect to concentric center O.

$$\theta = -\sqrt{2\ln\frac{r}{r_0}} \quad \text{Equation \{8\}}$$

The variation in angular displacement Δθ may also be expressed generally in terms of radial position r, e.g., r=r(θ), as shown in Equation 9. In one example, this equation approximates the path, i.e., fluid trajectory 116, of an idealized polishing medium as it moves freely across polishing surface 104, without consideration of the effects of viscosity and surface tension.

$$r = r_O e^{\frac{1}{2}\theta^2} \quad \text{Equation \{9\}}$$

In view of the foregoing, one approach for determining groove shape 112 of each groove 108 of polishing pad 100 (FIG. 1) is to make at least a significant portion of each groove orthogonal to fluid trajectory as defined by Equations 8 and 9 above. In this manner, grooves 108 will be shaped to resist the motion of the polishing medium by opposing the various patterns of motion, as discussed above.

To determine the equation of a groove shape, e.g., groove shape 112, orthogonal to fluid trajectory 116, it is beneficial to know the slope s of the fluid trajectory. In general, slope s of fluid trajectory 116, expressed as a function of polar coordinates θ=θ(r), is as shown in Equation 10.

$$s = \frac{1}{r}\frac{dr}{d\theta} = \frac{1/r}{d\theta/dr} \quad \text{Equation \{10\}}$$

The derivative (Equation 10) of fluid trajectory 116 of Equation 8 may be used to determine the slope s (Equation 12) of the trajectory 116.

$$\frac{d\theta}{dr} = \frac{1}{2\sqrt{2\ln\frac{r}{r_O}}} \quad \text{Equation \{11\}}$$

$$s = -\sqrt{2\ln\frac{r}{r_O}} \quad \text{Equation \{12\}}$$

To be orthogonal, the slope s* of groove shape 112 must be such that the product of slope s and slope s* is −1 at all points on fluid trajectory 116. Therefore, the slope s* of groove shape 112 orthogonal to fluid trajectory 116 defined by Equation 13 is as follows:

$$s^* = \sqrt{2\ln\frac{r}{r_O}} \quad \text{Equation \{13\}}$$

Slope s* of groove shape 112 defined by Equation 13 may be used in conjunction with Equation 10 to determine the derivative (Equation 14) of the orthogonal curve. Then, the orthogonal trajectory θ*=θ*(r) (Equation 15) may be found by separating and integrating Equation 14.

$$\left(\frac{dr}{d\theta}\right)^* = \frac{r}{\sqrt{2\ln\frac{r}{r_O}}} \quad \text{Equation \{14\}}$$

$$\theta^* = \frac{1}{3}\left(2\ln\frac{r}{r_O}\right)^{3/2} \quad \text{Equation \{15\}}$$

The orthogonal trajectory may also be expressed as r*=r*(θ), as shown in Equation 16, by solving Equation 15 for r.

$$r^* = r_O e^{\frac{1}{2}(3\theta)^{3/2}} \quad \text{Equation \{16\}}$$

Referring to FIG. 3, and also to FIG. 1, once groove shape 112 (FIG. 3) has been established so that it is orthogonal to fluid trajectory 116 over at least a portion of the length of the corresponding groove 108, the groove may be repeated circumferentially around polishing pad 100 as desired, e.g., as shown in FIG. 1. Although the best polishing medium retention may be achieved if each groove extended from the central portion of polishing pad 100 to the outer periphery of the pad, it is recognized that in some embodiments it will be desirable to make less than the entire length of the grooves be orthogonal, that is, forming a local angle of between 45 and 135 degrees, to the fluid trajectory. Generally, however, it is desirable that the orthogonal portion of each groove extend through at least 50% of the width of the wafer track, which is depicted as 140 on FIG. 1. For example, each groove 108 shown in FIG. 1 is orthogonal to fluid trajectory 116 along its entire length.

Figure 4:
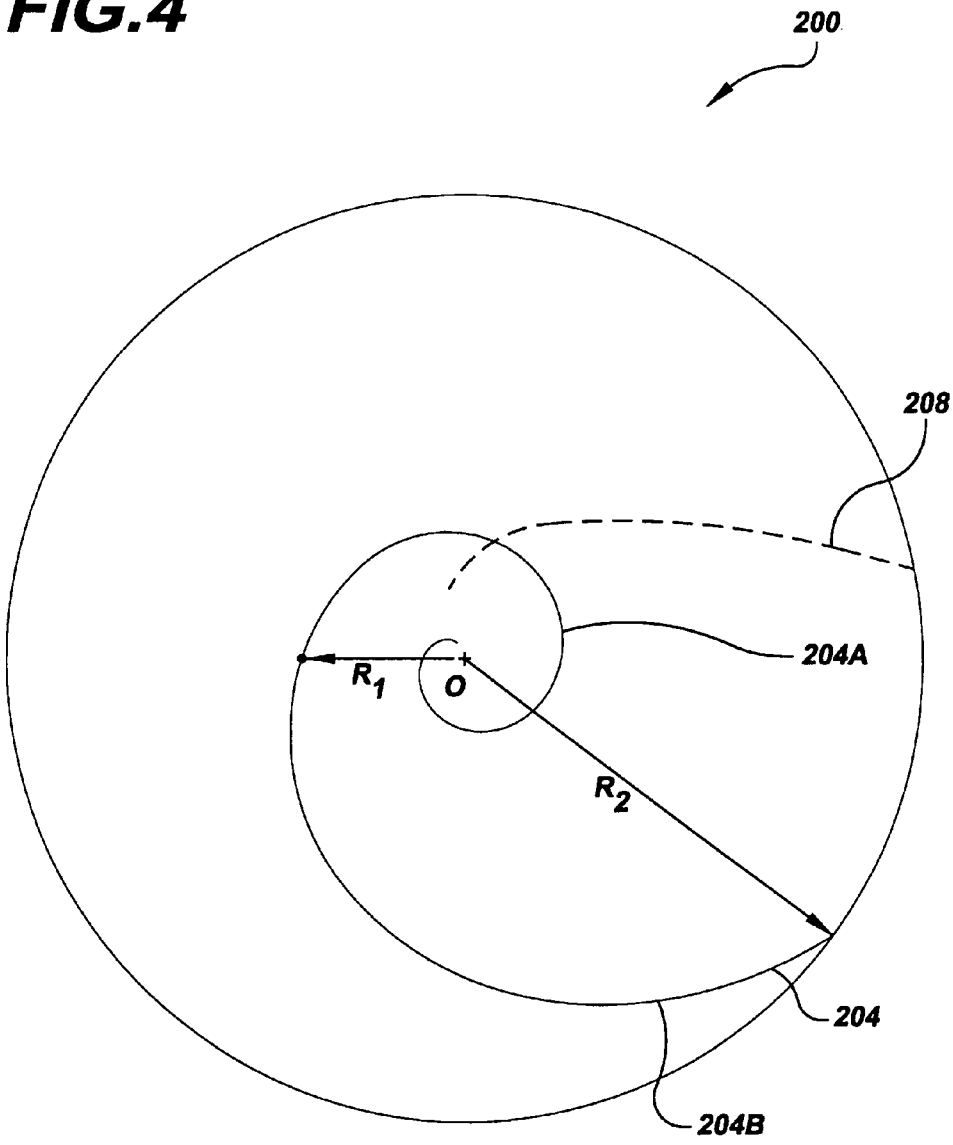
FIG. 4 is a schematic plan view of an alternative polishing pad made in accordance with the present invention illustrating the shape of one of the grooves on the pad.
Figure 5:
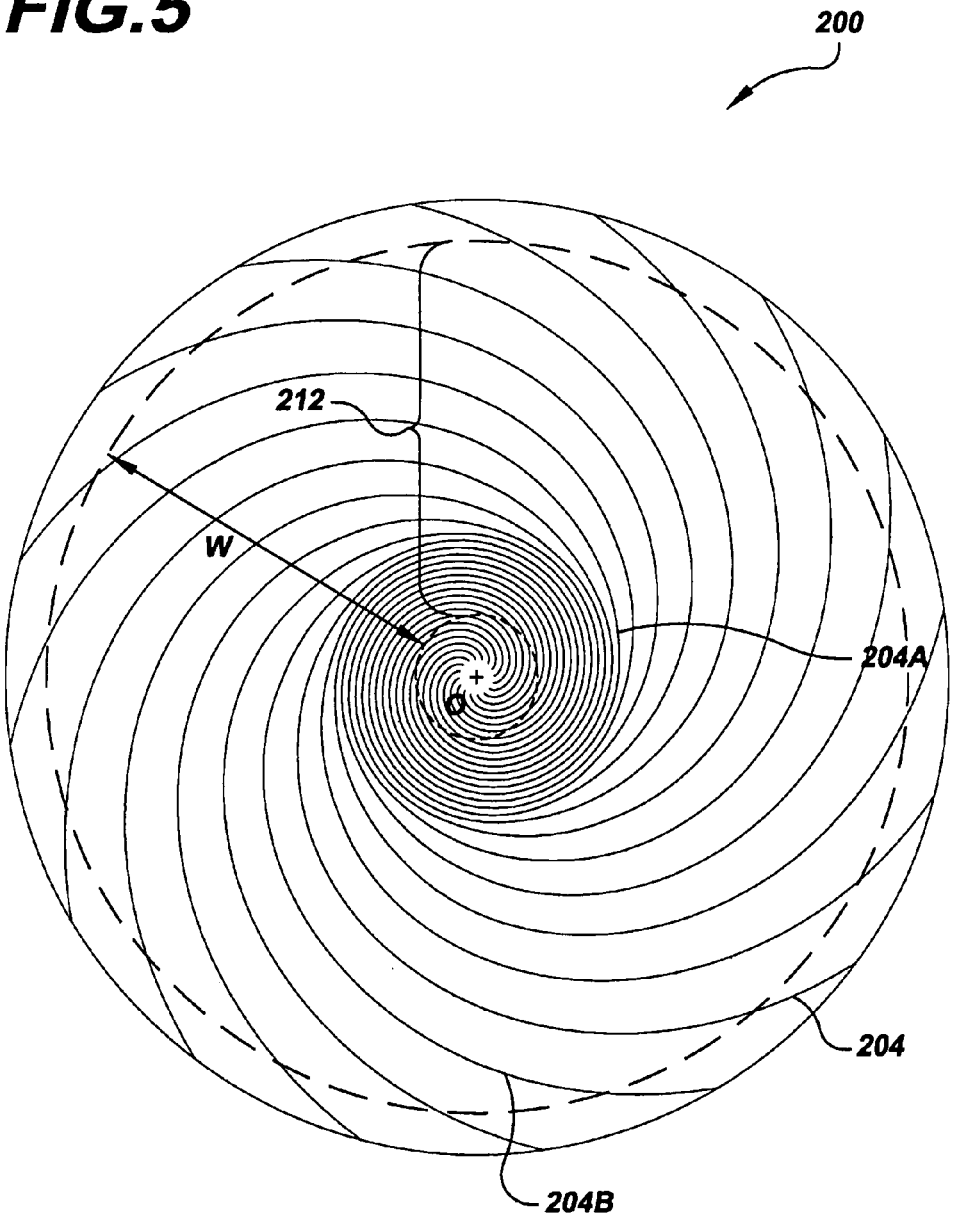
FIG. 5 is a plan view of the polishing pad of FIG. 4 showing the complete formation of the polishing pad.

For the sake of illustrating the principles described above, FIGS. 4-7 show alternative polishing pads 200, 300, which illustrate but two of many alternative groove designs that may be made using these principles. Referring first to FIGS. 4 and 5, polishing pad 200 includes a plurality of grooves 204 (FIG. 5) each including an inner portion 204A shaped without regard to the fluid trajectory 208 (FIG. 4) and having benefits disclosed in U.S. Pat. No. 6,783,436, Polishing Pad with Optimized Grooves and Method of Forming Same, issued Aug. 31, 2004 to Muldowney and incorporated herein by reference. Each of the plurality of grooves 204 (FIG. 5) also includes an outer portion 204B shaped so as to be orthogonal to the fluid trajectory. In this example, each inner portion 204A of the plurality of grooves 204 extends from a point proximate the concentric center O of polishing pad 200 to a point at radius $R_1$ (FIG. 4), here about one-third the radius of the pad. The orthogonal outer portion 204B of each groove 204 extends from the corresponding respective point at radius $R_1$ to radius $R_2$, which in this example is the overall radius of polishing pad 200. As seen in FIG. 5, about four-fifths of the width W of wafer track 212 includes orthogonal outer portions 204B of grooves.

Figure 6:
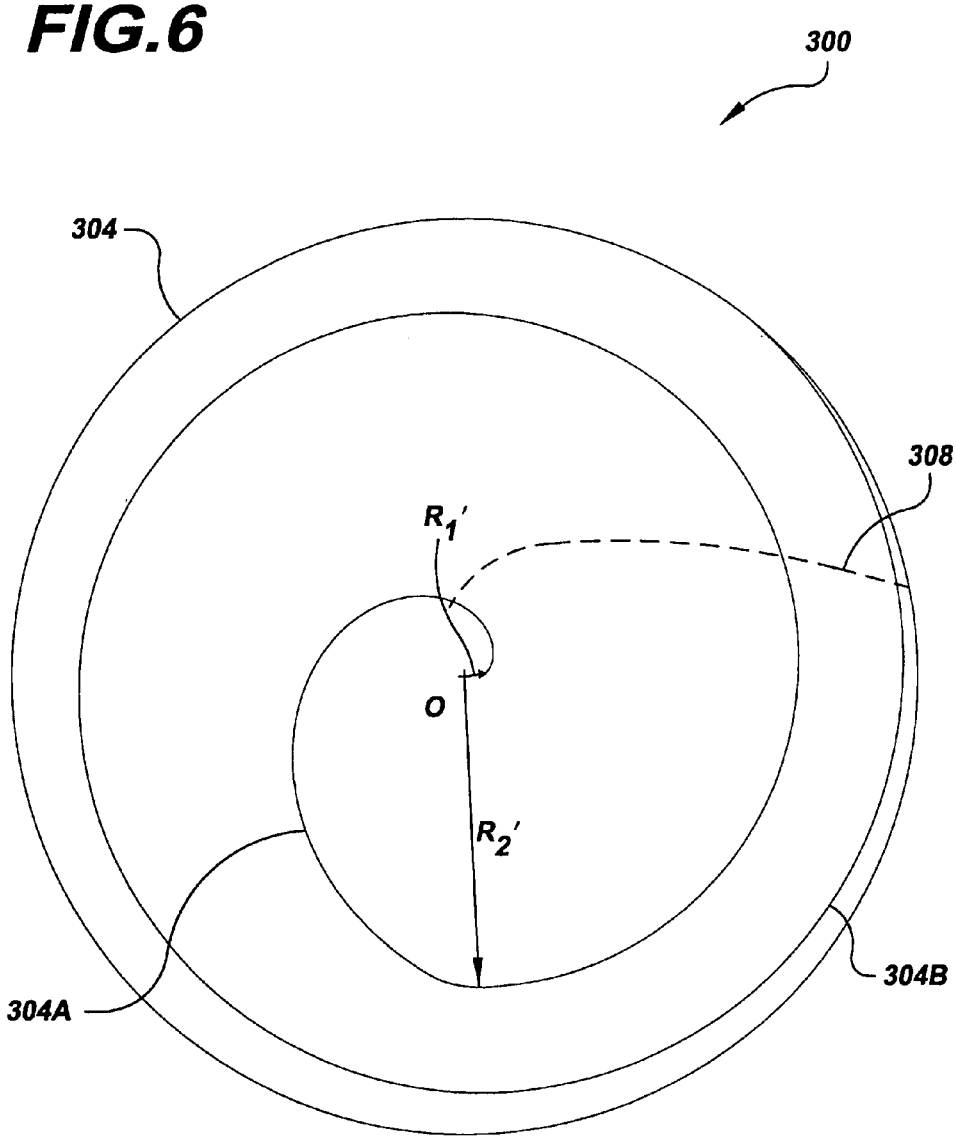
FIG. 6 is a schematic plan view of another alternative polishing pad made in accordance with the present invention illustrating the shape of one of the grooves on the pad.
Figure 7:
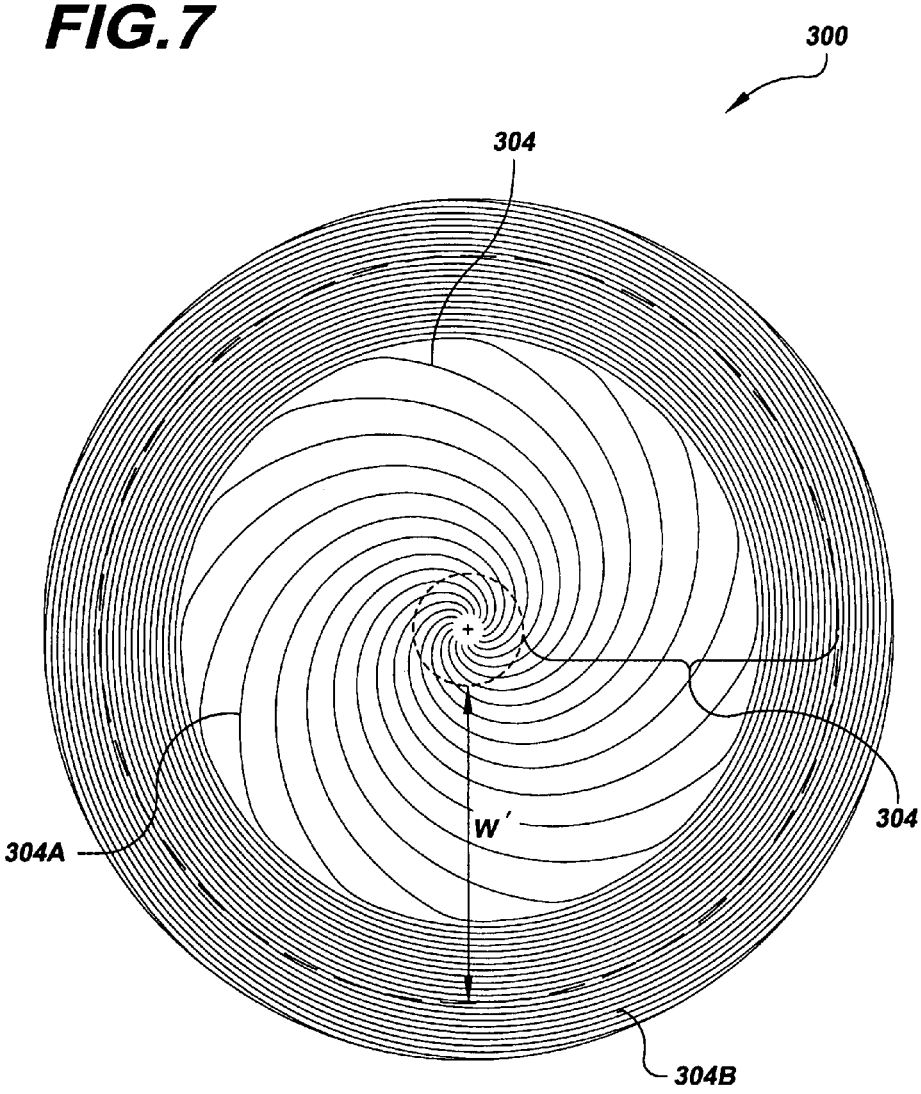
FIG. 7 is a plan view of the polishing pad of FIG. 6 showing the complete formation of the polishing pad.

Referring next to FIGS. 6 and 7, polishing pad 300 includes a plurality of grooves 304 that are configured opposite from grooves 204 of FIG. 5. That is, instead of having the orthogonal portions of the grooves radially outward from the generally non-orthogonal portions, the inner portion 304A of each groove 304 of polishing pad 300 (FIG. 7) is shaped to be orthogonal to the fluid trajectory 308 (FIG. 6) and the outer portion 304B is shaped without regard to its orthogonality to the fluid trajectory and having benefits disclosed in U.S. Pat. No. 6,783,436, discussed above. In this example, each orthogonal inner portion 304A extends from a point on radius $R_1'$ near the concentric center O of polishing pad 300 to a point at a radius $R_2'$, which in this case is about two-thirds the overall radius of the pad. The corresponding respective not-intentionally-orthogonal outer portion 304B extends from the point on radius $R_2'$ to the outer periphery of polishing pad 300. As can be readily seen in FIG. 7, about two-thirds of the width W' of wafer track 312 contains orthogonal inner portions 304A of grooves 304.

As will be appreciated by those skilled in the art, while not-intentionally-orthogonal inner portions 204A of grooves 204 of FIG. 5 and not-intentionally-orthogonal outer portions 304B of grooves 304 of FIG. 7 are shown as being spiral in shape, this need not be so. For example, in other embodiments, the spiral shaped grooves may be replaced by grooves of other shapes and orientations, such as straight and radial, slightly curved and radial, zigzag and radial, zigzag and circumferential, wavy and radial and wavy and circumferential, to name just a few. The not-intentionally-orthogonal portions of the grooves may also be overlays of other simpler grooves patterns, such as Cartesian grids or overlays of grids and circular or spiral patterns. In addition, other embodiments can have other overall configurations of grooves. For example, some embodiments can be hybrids of polishing pads 200, 300 of FIGS. 5 and 7. That is, alternative embodiments may include grooves each having a central portion shaped so as to be orthogonal to the relevant fluid trajectory and inner and outer portions that are not intentionally orthogonal to the fluid trajectory.

Figure 8:
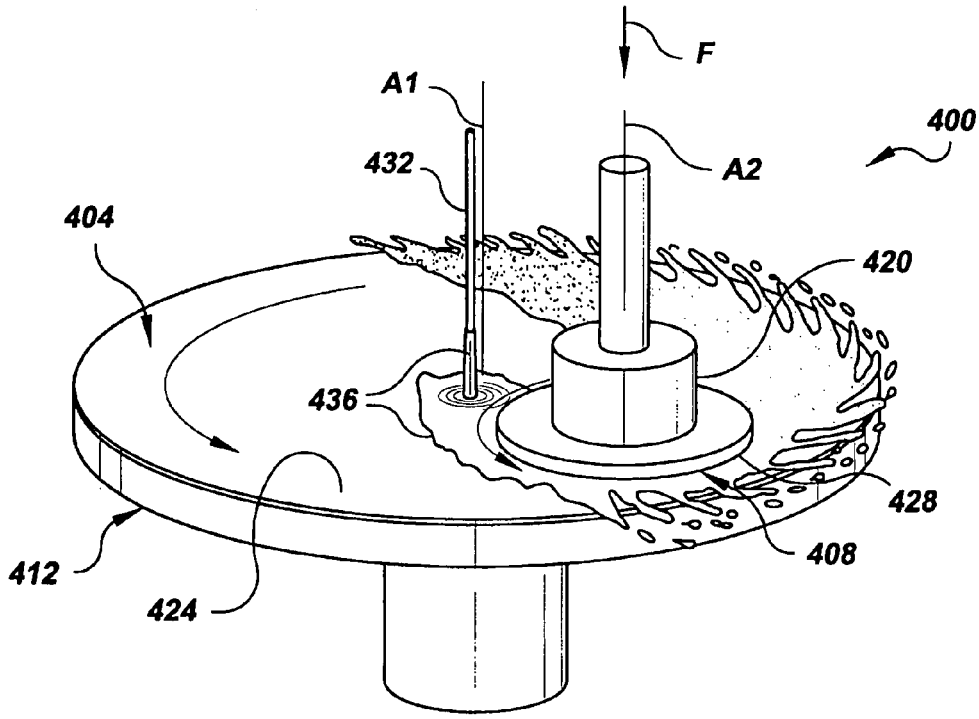
FIG. 8 is a schematic diagram of a polishing system in accordance with the present invention.

FIG. 8 illustrates a polisher 400 suitable for use with a polishing pad 404, which may be one of polishing pads 100, 200, 300 of FIGS. 1-7 or other polishing pad of the present disclosure, for polishing an article, such as a wafer 408. Polisher 400 may include a platen 412 on which polishing pad 404 is mounted. Platen 412 is rotatable about a rotational axis A1 by a platen driver (not shown). Polisher 400 may further include a wafer carrier 420 that is rotatable about a rotational axis A2 parallel to, and spaced from, rotational axis A1 of platen 412 and supports wafer 408 during polishing. Wafer carrier 420 may feature a gimbaled linkage (not shown) that allows wafer 408 to assume an aspect very slightly non-parallel to the polishing surface 424 of polishing pad 404, in which case rotational axes A1, A2 may be very slightly askew relative to each other. Wafer 408 includes a polished surface 428 that faces polishing surface 424 and is planarized during polishing. Wafer carrier 420 may be supported by a carrier support assembly (not shown) adapted to rotate wafer 408 and provide a downward force F to press polished surface 424 against polishing pad 404 so that a desired pressure exists between the polished surface and the pad during polishing. Polisher 400 may also include a polishing medium inlet 432 for supplying a polishing medium 436 to polishing surface 424.

As those skilled in the art will appreciate, polisher 400 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 408 and polishing pad 404; (2) controllers and selectors for varying the rate and location of delivery of polishing medium 436 to the pad; (3) controllers and selectors for controlling the magnitude of force F applied between the wafer and polishing pad, and (4) controllers, actuators and selectors for controlling the location of rotational axis A2 of the wafer relative to rotational axis A1 of the pad, among others. Those skilled in the art will understand how these components are constructed and implemented such that a detailed explanation of them is not necessary for those skilled in the art to understand and practice the present invention.

During polishing, polishing pad 404 and wafer 408 are rotated about their respective rotational axes A1, A2 and polishing medium 436 is dispensed from polishing medium inlet 432 onto the rotating polishing pad. Polishing medium 436 spreads out over polishing surface 424, including the gap between wafer 408 and polishing pad 404. Polishing pad 404 and wafer 408 are typically, but not necessarily, rotated at selected speeds of 0.1 rpm to 850 rpm. Force F is typically, but not necessarily, of a magnitude selected to induce a desired pressure of 0.1 psi to 15 psi (6.9 to 103 kPa) between wafer 408 and polishing pad 404.

The invention claimed is:

1. A polishing pad for use in conjunction with a polishing medium having an ideal trajectory imparted by the rotation of the polishing pad during use, the polishing pad comprising:

(a) a polishing layer configured for polishing at least one of a magnetic, optical and semiconductor substrate in the presence of a polishing medium, the polishing layer including a circular polishing surface having an annular polishing track during polishing; and (b) at least one groove formed in the polishing layer and having an orthogonal portion located within the polishing track, the orthogonal portion having a length and being shaped along the entire length to be orthogonal to the trajectory angle θ of the ideal fluid trajectory along the orthogonal portion.

2. The polishing pad according to claim 1, wherein the polishing track has a width and the orthogonal portion traverses at least 50% of the width.

3. The polishing pad according to claim 2, wherein the orthogonal portion traverses at least 75% of the width of the polishing track.

4. The polishing pad according to claim 1, comprising a plurality of grooves partially defined by repeating the orthogonal portion circumferentially around the polishing surface.

5. The polishing pad according to claim 4, wherein the plurality of grooves are partially defined by repeating the orthogonal portion circumferentially around the polishing surface at a constant angular pitch.

6. The polishing pad according to claim 1, wherein the shape of the orthogonal portion is defined by the equation $$r^* = r_O e^{\frac{1}{2}(3\theta)^{3/2}}$$

where $r_o$ is the initial radial position from a concentric center of the polishing pad and θ is the trajectory angle.

7. A polishing pad, comprising:

(a) a polishing layer configured for polishing at least one of a magnetic, optical and semiconductor substrate in the presence of a polishing medium; and (b) at least one groove formed in the polishing layer and having an orthogonal portion located within the polishing track, the orthogonal portion having a length and being shaped in accordance with the equation $$r^* = r_O e^{\frac{1}{2}(3\theta)^{3/2}}$$

where $r_o$ is the initial radial position from a concentric center of the polishing pad and θ is the trajectory angle.

8. The polishing pad according to claim 7, wherein the polishing surface includes, during polishing, a polishing track having a width, the orthogonal portion traversing at least 50% of the width.

9. The polishing pad according to claim 7, comprising a plurality of grooves partially defined by repeating the orthogonal portion circumferentially around the polishing surface at a constant angular pitch.

* * * * *

UNITED STATES PATENT AND TRADEMARK OFFICE

CERTIFICATE OF CORRECTION

PATENT NO. : 7,311,590 B1
APPLICATION NO. : 11/700346
DATED : December 25, 2007
INVENTOR(S) : Muldowney It is certified that error appears in the above-identified patent and that said Letters Patent is hereby corrected as shown below:

Column 5, Equation {7} replace $\ln(r) = \frac{1}{2}\Delta\theta + C$ with $\ln(r) = \frac{1}{2}(\Delta\theta)^2 + C$ Column 6, Equation {11} replace $\frac{d\theta}{dr} = \frac{1}{r\sqrt{2\ln\frac{r}{r_o}}}$ with $\frac{d\theta}{dr} = \frac{-1}{r\sqrt{2\ln\frac{r}{r_o}}}$ Column 6, Equation {13} replace $s^* = \sqrt{2\ln\frac{r}{r_o}}$ with $s^* = \left(\sqrt{2\ln\frac{r}{r_o}}\right)^{-1}$ Column 2, lines 55 to 60, Column 9, Equation 16, Claims 6 and 7 replace $r^* = r_o e^{\frac{1}{2}(3\theta)^{2/3}}$ with $r^* = r_o e^{\frac{1}{2}(3\theta)^{2/3}}$ Signed and Sealed this Thirty-first Day of August, 2010

David J. Kappos

David J. Kappos
*Director of the United States Patent and Trademark Office*